US005255694A

United States Patent [19]

Caruso

[11] Patent Number: 5,255,694

[45] Date of Patent: Oct. 26, 1993

[54] HAIR CURLER STEAMER HAVING IMPROVED CURLER SUPPORT

[76] Inventor: Richard B. Caruso, 619 Croyden Rd., Cheltenham, Pa. 19102

[21] Appl. No.: 755,124

[22] Filed: Sep. 5, 1991

[51] Int. Cl.[5] ..... A45D 6/06

[52] U.S. Cl. ..... 132/228; 132/227; 132/272

[58] Field of Search ..... 132/227, 228, 271, 272

[56] References Cited

U.S. PATENT DOCUMENTS

| | | | |
|---|---|---|---|
| 3,563,251 | 2/1971 | Jorgensen | 132/227 |
| 3,584,632 | 6/1971 | Weidner et al. | 132/271 |
| 3,614,381 | 10/1971 | Popeil | 132/228 |
| 3,739,787 | 6/1973 | Keldmann et al. | 132/227 |
| 3,749,106 | 7/1973 | Kelmann et al. | 132/227 |
| 4,510,953 | 4/1985 | Caruso | 132/228 |
| 4,771,797 | 9/1988 | Kosaka | 132/272 |

FOREIGN PATENT DOCUMENTS

| | | | |
|---|---|---|---|
| 2338330 | 2/1975 | Fed. Rep. of Germany | 132/227 |
| 2539012 | 7/1984 | France | 132/227 |

*Primary Examiner*—Gene Mancene
*Assistant Examiner*—Frank A. LaViola
*Attorney, Agent, or Firm*—Woodcock, Washburn, Kurtz Mackiewicz & Norris

[57] ABSTRACT

A steamer is provided for use with hair curlers having a steam passage formed therein. The steamer comprises (i) a vessel forming a cavity for containing water, (ii) an electrode for heating the water contained in the cavity thereby transforming at least a portion of the water to steam, (iii) a housing supporting the electrode disposed atop the vessel and having a first steam discharge port formed therein in flow communication with the cavity, (iv) a cover disposed atop the housing and having a second steam port formed therein in flow communication with the first steam port, and (v) a handle for lifting the steamer attached to the cover. The handle has (i) a support portion adapted to support one of the hair curlers while the steam is introduced therein, (ii) a third steam discharge port formed in the support portion and in flow communication with the second steam discharge port, and (iii) a post for stabilizing one of the hair curlers while the steam is introduced therein. The post extends upward from the support portion, whereby the post is adapted to extend into the steam passage in the hair curler, and forms a longitudinally extending central portion having three longitudinally extending spokes equidistantly circumferentially spaced around the central portion and extending radially outward therefrom.

17 Claims, 7 Drawing Sheets

FIG. 4
PRIOR ART
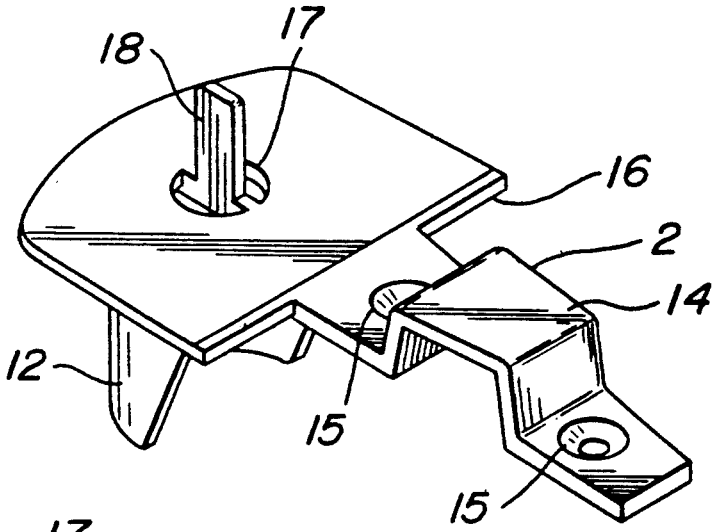
FIG. 5
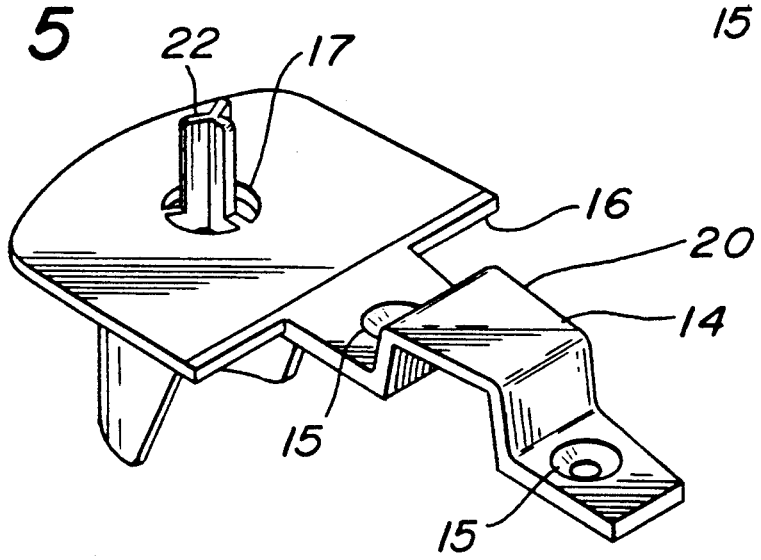
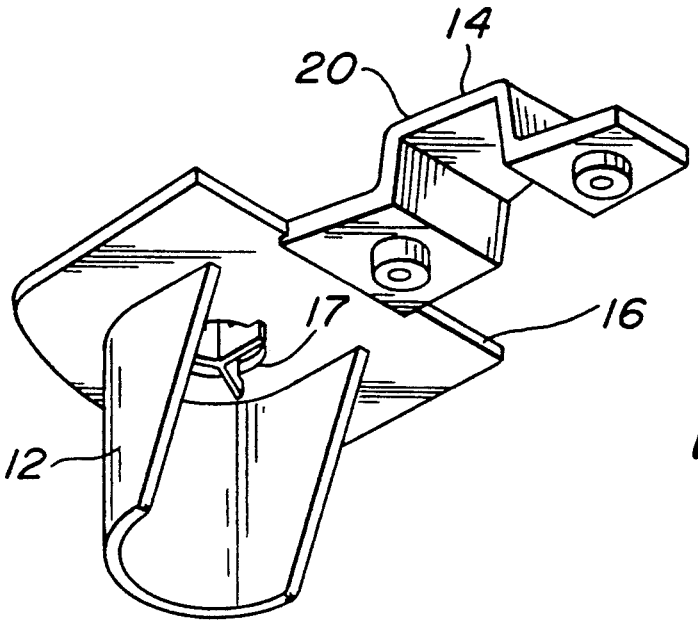
FIG. 6

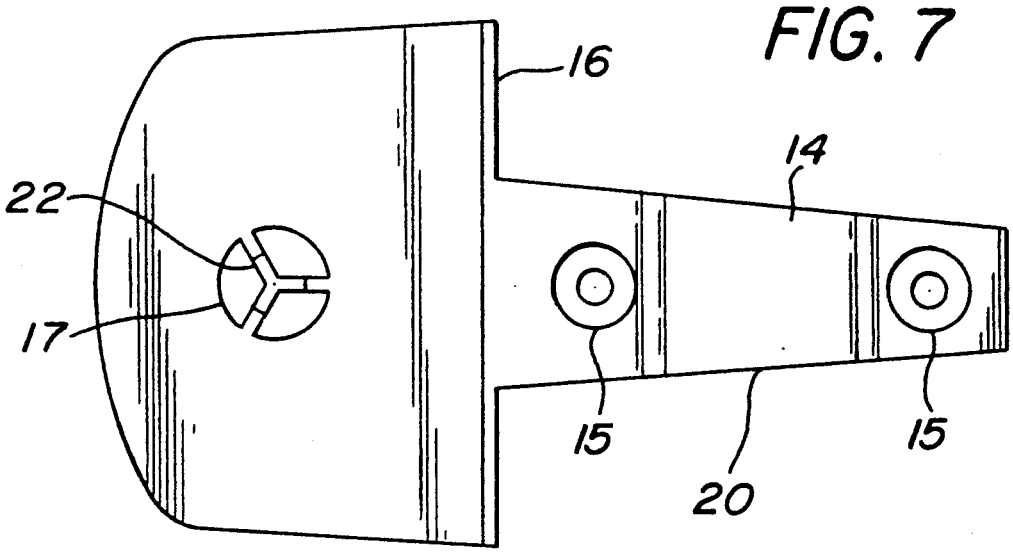
FIG. 7
FIG. 8
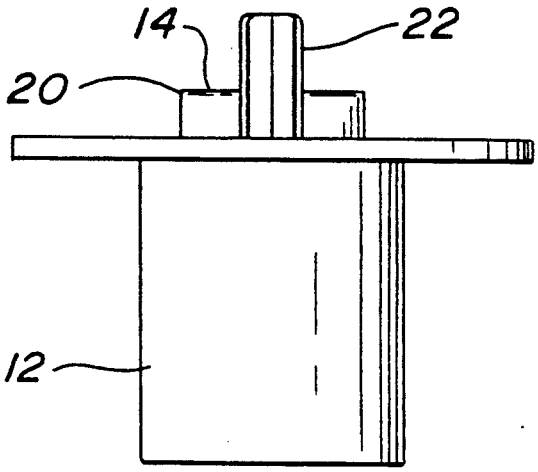
FIG. 9
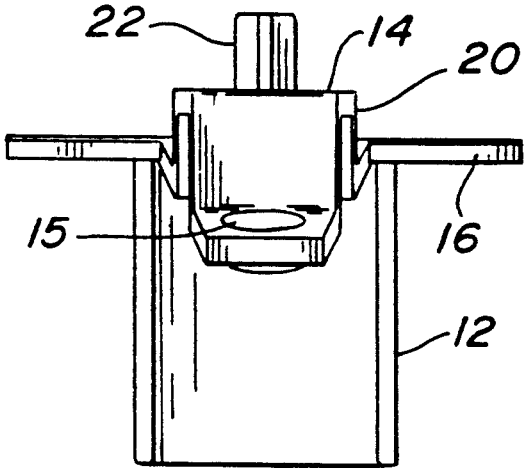
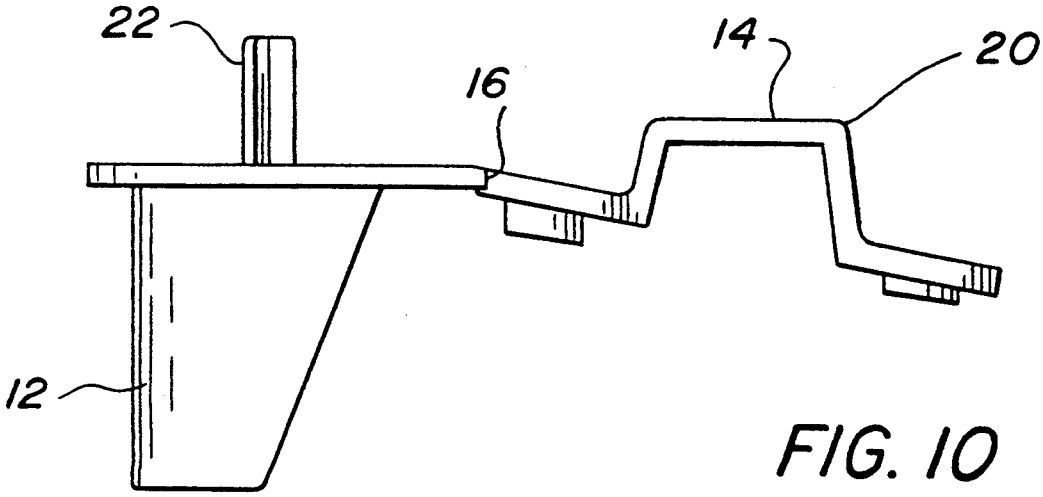
FIG. 10

HAIR CURLER STEAMER HAVING IMPROVED CURLER SUPPORT

FIELD OF THE INVENTION

The current invention is directed to a steamer for use with hair curlers. More specifically, the current invention is directed to a hair curler steamer having an improved post for supporting the hair curlers and for directing the flow therethrough.

BACKGROUND OF THE INVENTION

In the past, porous hair curlers have been developed that use steam to aid in curling—see for example, U.S. Pat. No. 4,453,554 (Caruso), hereby incorporated by reference in its entirety. One such hair curler 42 is shown in FIGS. 1 and 2. The hair curler 42 includes a core 48 having an integral rim 46 formed on one end. The core 48 is hollow and forms a steam passage 50 that extends longitudinally therethrough. An inlet for the steam passage 50 is disposed in the integral rim 46. The core 48 has a reduced diameter portion 62 which telescopically receives a hub 64 formed on a second rim 46, the outer diameter of hub 64 being approximately equal to the outer diameter of core 48.

The second rim 46 does not have a hole in communication with the steam passage 50 so that the passage is sealed at one end. However, the core 48 has two longitudinally extending slots 22 equidistantly circumferentially spaced around the core 48—that is, the slots are spaced approximately 180° from each other. The slots 22 terminate at the reduced diameter portion 62 and allow steam within the passage 50 to flow radially out of the core 48 and through a tubular porous sleeve 44.

The sleeve 44 surrounds the core 48 and is preferably formed from a foam polymeric plastic material so as to be highly porous and compressible. The sleeve 44 acts to distribute steam escaping from the slots 60 to the hair wound therearound. The curler 42 is assembled by telescoping the sleeve 44 over the core 48 and then snapping the hub 64 onto the reduced diameter portion 62 with a friction fit.

A shield 58 is provided to retain heat by partially enclosing the sleeve after the hair has been wound therearound. The shield 58 is generally semi-circular and has end walls. A notch is provided in each end wall having a transverse dimension that corresponds generally to the diameter of the core 48 and hub 64. In addition, the end walls have a slight interference fit with the inner surfaces of the rims 46.

The hair curler 42 is preferably provided in sets of different diameters—a set of small diameter curlers for use with short hair, a set of intermediate diameter curlers for use with hair of intermediate length, and a set of large diameter curlers for use with long hair.

The hair curler 10 is used as follows. The core 48, while enclosed by the sleeve 44, is placed on a table top steamer, such as that shown in FIG. 3 and discussed further below. After a few seconds, the curler is removed and applied to the hair, while the shield 58 is placed over the steam discharge port 38 in the cover 3 of the steamer 1. After hair has been wound around the sleeve 44, the shield 58 is placed around the sleeve to contain the steam. A pin or clip may also be utilized to anchor the hair to the rims 46.

After exposing the hair to the steam escaping radially outwardly through slots 60 and sleeve 44 for a few minutes, the clip and shield 58 are removed. Thereafter, the curler is separated from the hair. As the hair curler is pulled away from the head, the curler spins and unwinds itself from the hair.

FIG. 3 shows a table top steamer 1, according to the prior art, such as heretofore used in conjunction with the curler 42. The steamer 1 comprises an outer vessel 24 that forms a cavity 9 for containing the water, into which a quantity of salt may be added, to be transformed into steam. An outer housing 8, having an inner cylinder 26 concentrically disposed therein, is mounted into the vessel 24. An inner housing 7, having a shroud 13 extending downward therefrom, is disposed within the outer housing 8 and sealed thereto by a gasket 5.

As shown in FIG. 3, an inner cap 4, having electrodes 6 mounted therein for heating the water and thereby transforming it into steam, is disposed within the inner housing 7 and sealed thereto with a second gasket 5. Power cables 56 are connected to the electrodes 6. A steam discharge port 10, in flow communication with the cavity 9, is formed in the inner cap 4. The inner cap steam discharge port 10 serves to direct steam to the passage 50 within the hair curler core 48 when the curler is mounted on the steamer as discussed below. In addition, steam vents 11, adapted to vent excess steam to atmosphere, are formed on either side of the steam port 10. A cover 3 is mounted atop the inner cap 4. A steam port 38 is formed in the cap 3 which is concentric with, and therefore in flow communication with, the inner cap steam port 10. Lastly, a plastic handle/curler support 2 is attached to the cover 3 via screws 40.

As shown in FIG. 4, the handle/curler support 2 has a finger grip portion 14, disposed between two holes 15 for the attaching screws 40, to facilitate lifting of the steamer 1. A planar portion 16 extends forwardly from the finger grip portion 14. The planar portion 16 serves to support a hair curler 42 on the steamer while steam is being introduced therein and also serves as a baffle to deflect excess steam discharging from the vents 11 away from the user. A cowl 12 extends downwardly from the planar portion 16 and, in use, partially encircles the steam ports 10 and 38 so that, in cooperation with the face of the cover 3, forms a sealed conduit for directing the steam discharged from the steamer 1 to the curler steam passage 50.

As shown in FIG. 4, a hole 17 is formed in the planar portion 16. The hole 17, via the aforementioned conduit formed by the cowl 12, is in flow communication with the inner cap and cover steam ports 10 and 38, respectively. The hole 17 serves as a steam port for the introduction of steam into the curler steam passage 50. A post 18 is disposed in the curler steam port 17 and, by extending into the passage 50, serves to stabilize the curler 10 while it is supported on the planar portion 16. As shown in FIG. 4, the post 18 is a flat plate-like projection. Unfortunately, as a result of its plate-like configuration, the post 22 is fairly weak and prone to breakage, due to bending forces imposed on it during shipping and in use, unless its width and thickness are sufficiently great. This limitation on the minimum size of the post 22 prevents the use of very small diameter curlers, since such curlers would have very small diameter steam passages 50 and excessive width and thickness of the post would impede steam flow through the passage. Thus, the applicability of the steam curling approach has been undesirably limited.

Accordingly, it would be desirable to provide a steamer having a hair curler support which allowed the use of very small diameter hair curlers.

SUMMARY OF INVENTION

It is an object of the current invention to provide a steamer adapted to stably support a hair curler thereon.

It is another object of the invention that the steamer be adapted to support hair curlers having small steam passages extending therethrough.

It is yet another object of the invention that the steamer advantageously transport the steam produced therein to the steam passage in the hair curler.

These and other objects are accomplished in a steamer for use with hair curlers having a steam passage formed therein. The steamer has (i) a vessel forming a cavity for containing water, (ii) means for transforming at least a portion of the water contained in the cavity to steam, (iii) a cover disposed atop the vessel and having a first steam discharge port formed therein in flow communication with the cavity, and (iv) a support member for supporting one of the hair curlers while the steam is introduced therein. The support member is attached to the cover and has a second steam discharge port formed therein in flow communication with the first steam discharge port. A portion of the support member forms a post disposed in the second steam discharge port and extending into the steam passage in the hair curler. The post forms a longitudinally extending central portion having at least three longitudinally extending spokes extending radially outward therefrom.

In one embodiment, the three spokes are equidistantly circumferentially spaced around the central portion. The hair curler has a longitudinally extending core forming the steam passage and two longitudinally extending openings for discharging the steam are equidistantly circumferentially spaced around the core, whereby no more than one of the spokes can be adjacent the openings in the core when the post extends into the steam passage.

BRIEF DESCRIPTION OF THE DRAWINGS

FIG. 4 is a perspective view from above of the handle/curler support shown in FIG. 3 according to the prior art.

FIG. 5 is a perspective view from above of the handle/curler support according to the current invention.

FIG. 6 is a perspective view from below of the handle/curler support shown in FIG. 5.

FIG. 7 is a plan view from above of the handle/curler support shown in FIG. 5.

FIG. 8 is a front elevational view of the handle/curler support shown in FIG. 5.

FIG. 9 is a rear elevational view of the handle/curler support shown in FIG. 5.

FIG. 10 is a left side elevational view of the handle/curler support shown in FIG. 5.

DESCRIPTION OF THE PREFERRED EMBODIMENT

Figure 12:
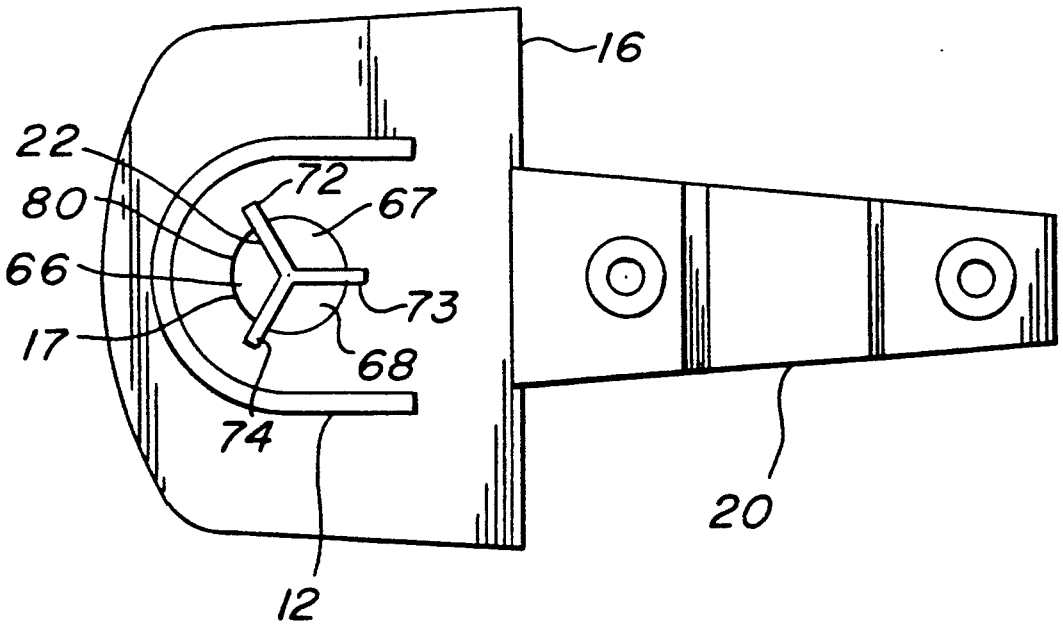
FIG. 12 is a plan view from below of the handle/curler support shown in FIG. 5.
Figure 13:
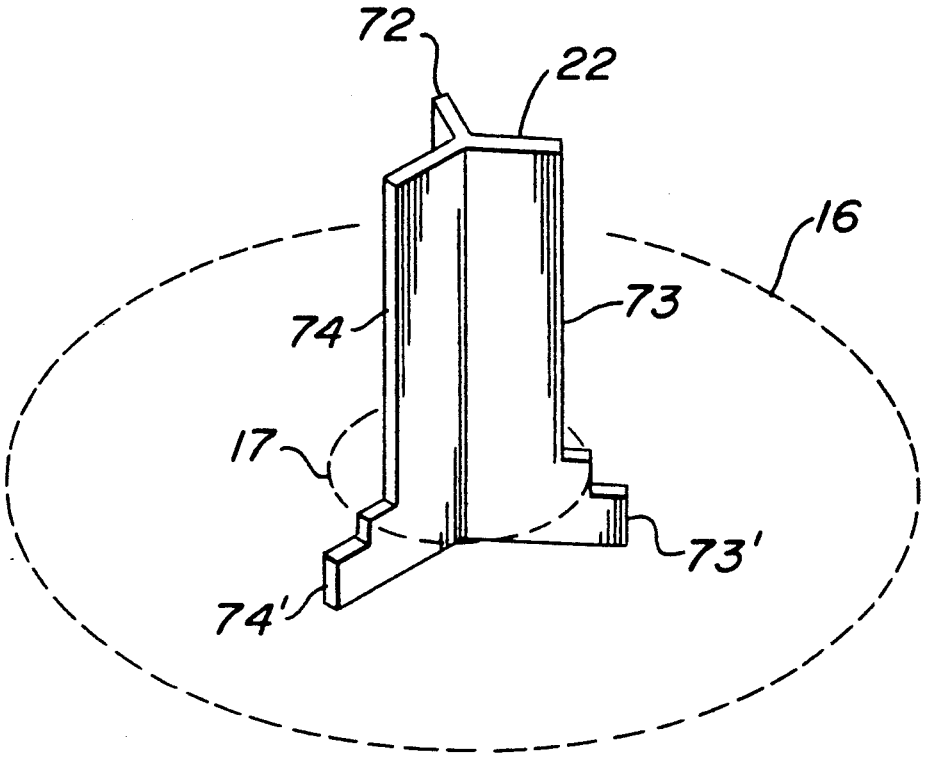
FIG. 13 is a perspective view of the post portion of the handle/curler support shown in FIG. 5.

Referring to the drawings in detail, wherein like numerals indicate like elements, there is shown in FIGS. 5–13 a handle/curler support 20 for the steamer 1 according to the current invention. As shown best in FIGS. 12 and 13, the handle/curler support 20 is similar to that previously used except that the post 22 forms a central portion 70, extending outwardly through the curler steam port 17, having three longitudinally extending plate-like spokes 72–74 extending radially outward therefrom. The spokes 72–74 divide the curler steam port 17 into three regions 66–68. As shown in FIGS. 6 and 13, each of the spokes 72–74 has a radial projection 72'–74', respectively, that extends beyond the curler steam port 17 on the underside of the planar portion 16 od the handle/curler support.

As a result of the spoked configuration, the post 22 has considerable strength. Consequently, it may be formed so as to be sufficiently narrow to penetrate a curler steam passage 50 having an inside diameter as little as 0.2 inch without becoming unduly subject to breakage. Moreover, the portions 66–68 of the steam port provide sufficient flow area for adequate steaming. In the preferred embodiment, the spokes 72—72 are circumferentially spaced and specially oriented, as explained below, so as to allow the maximum steam flow into the curler passage 50.

Figure 3:
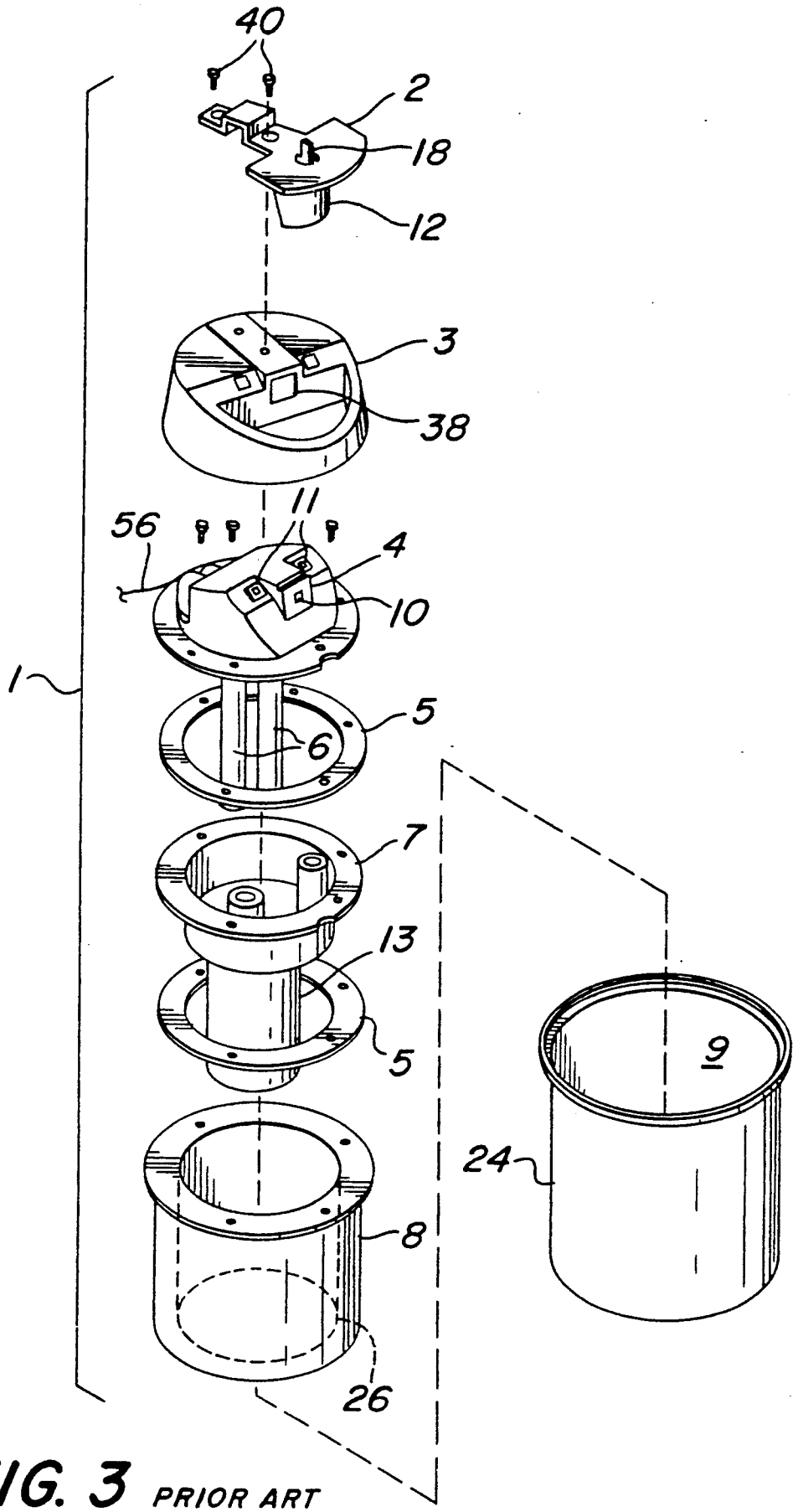
FIG. 3 PRIOR ART
FIG. 3 is an exploded view of a hair curler steamer according to the prior art.
Figure 11:
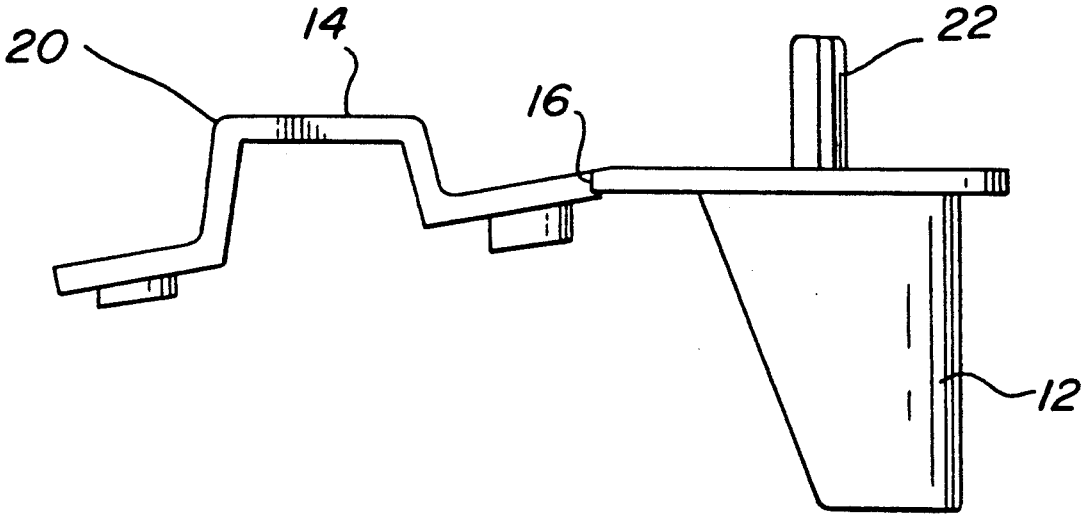
FIG. 11 is a right side elevational view of the handle/curler support shown in FIG. 5.
Figure 14:
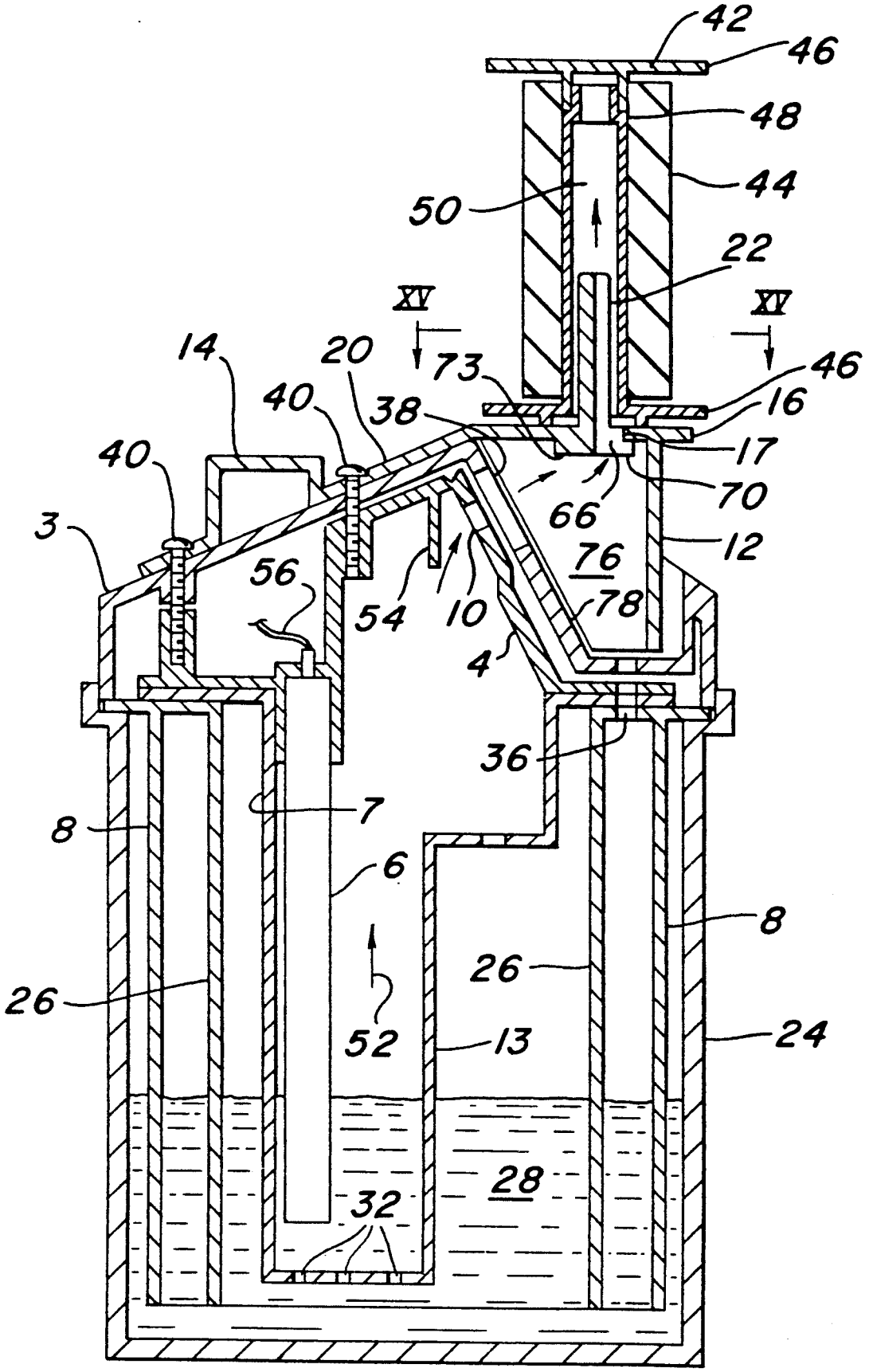
FIG. 14 is a longitudinal cross-section through the steamer shown in FIG. 3 incorporating the handle/curler support shown in FIG. 5 and having the curler shown in FIG. 1 mounter thereon.

As shown in FIG. 14, in operation, the electrodes 6 heat the water 28 contained in the vessel 24—more specifically, they heat the portion of the water 28 that flows into the shroud 13 of the inner housing 7 via holes 32—thereby forming steam 52. The steam 52 is then directed by baffle 54 to flow outward through the steam ports 10 and 38 in the inner cap 4 and cover 3, respectively. Excess steam flows out of the inner housing 7 via vents 11 in the inner cap 4, shown in FIG. 3. Returning to FIG. 14, any additional steam generated in the water 28 outside of the shroud 13 flows into the inner housing via hole 34 or into the conduit 76 formed by the cowl 12 via holes 36.

As shown in FIG. 14, a hair curler 42 is supported on the planar portion 16 of the handle/curler support 20 and is stabilized by the post 22. From the steam port 38, the steam 52 enters a conduit 76 formed by the cowl 12 and the front face 78 of the cover 3. The cowl 12 then directs the steam 52 so that it flows through the curler steam port 17 into the passage 50 in the hair curler 42.

Figure 1:
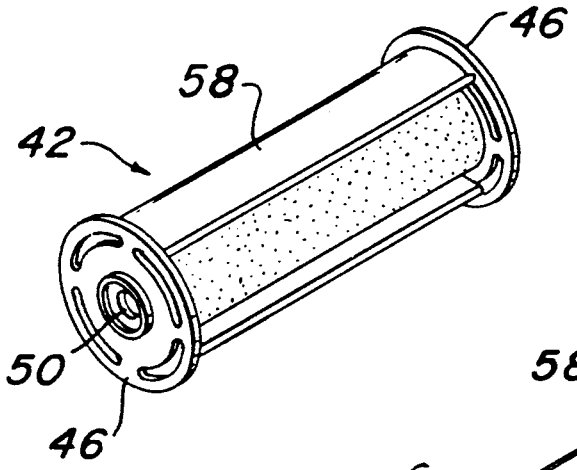
FIG. 1 PRIOR ART
FIG. 1 is a perspective view of a hair curler according to the prior art.
Figure 2:
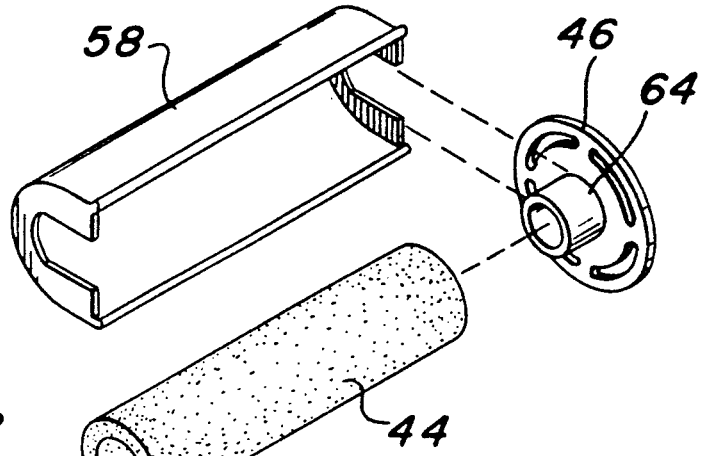
FIG. 2 PRIOR ART
FIG. 2 is an exploded view of the hair curler shown in FIG. 1.
Figure 15:
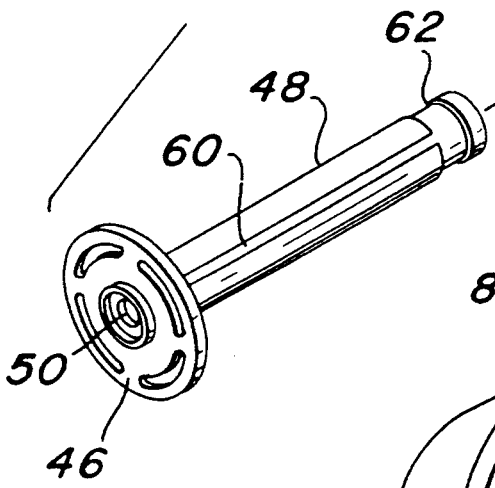
FIG. 15 is a cross-section taken through line XV—XV shown in FIG. 13.
Figure 15:
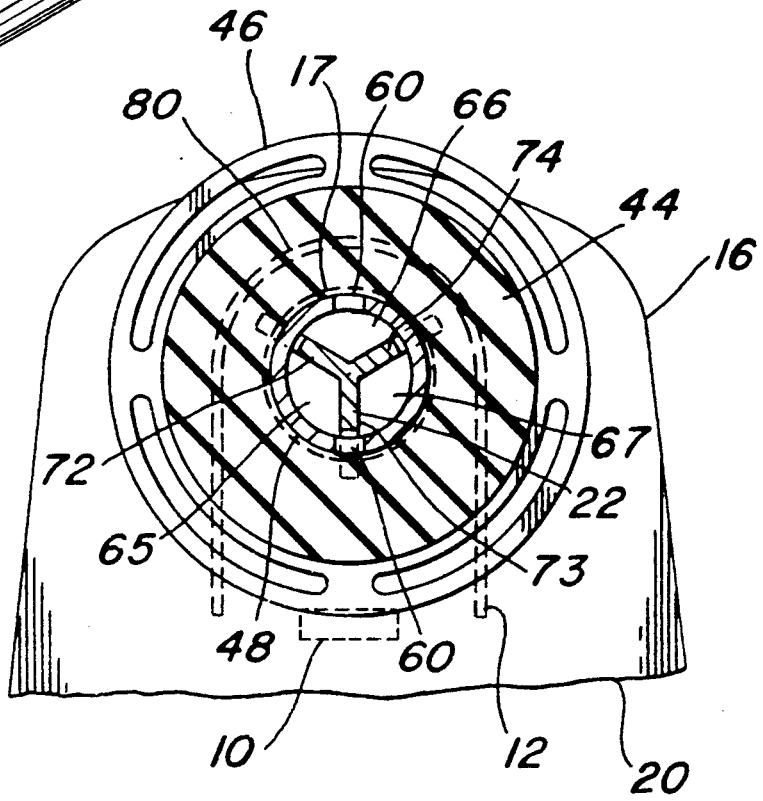

As shown in FIG. 12, in the preferred embodiment, the three spokes 72–74 are approximately equidistantly circumferentially spaced around the post central portion 70—that is, the spokes are spaced approximately 120° from each other. Thus, since the two slots 60 in the curler core 48 are spaced 180° apart, at most only one of the spokes 72–74 can be disposed adjacent a slot 60 and thereby block a portion of the steam flow through the slots, as shown in FIG. 15. This is in contrast to the previously used flat plate-like post 18, shown in FIG. 4, in which both edges of the post could be disposed adjacent a slot 60, thereby severely impeding steam flow. This feature provides an important advantage since, as a result of the sleeve 44 enclosing the core 48, the orientation of the slots 60 is not visible to the user so that care cannot be taken to ensure that the post does not block the slots 60. Although three spokes and two slots are used in the preferred embodiment, in general, for equally spaced spokes and slots, this advantage will be achieved whenever neither the number of spokes nor the number of slots 60 are an integer multiple of the other.

Since the cowl 12 serves as a baffle against which the steam impinges, the cowl directs the steam flow preferentially through the region 66 of the curler steam port 17 that is adjacent the forward portion 80 of the cowl directly opposite the inner cap steam port 10, shown in FIG. 12—that is, through the region of the curler steam port 17 that is furthest from the inner cap steam port 10. Thus, in the preferred embodiment, spoke 73, which is the spoke closest to the inner housing steam port 10, is disposed along the longitudinal centerline of the handle/curler support 20 and is oriented directly toward the inner cap steam port 10. Since there are three equally spaced spokes 72—72, as a result of this orientation of spoke 73, the region 66 of the curler steam port 17 adjacent the forward portion 80 of the cowl 12, and furthest from the inner cap steam port 10, is unobstructed, as shown in FIGS. 12 and 15, thereby making it ideally suited to receive steam flow.

As the foregoing indicates, as a result of the novel configuration and orientation of the post 22 according to the current invention, the post does not unnecessarily impede the flow of steam into the curler passage 50, even though the post has both adequate strength to avoid breakage and a sufficiently small cross-sectional size to penetrate very small curler steam passages 50.

The present invention may be embodied in other specific forms without departing from the spirit or essential attributes thereof and, accordingly, reference should be made to the appended claims, rather than to the foregoing specification, as indicating the scope of the invention.

What is claimed:

1. An apparatus for curling hair, comprising:

a) a vessel forming a cavity for containing water;

b) means for transforming at least a portion of said water contained in said cavity to steam;

c) a cover disposed atop said vessel;

d) a hair curler having a longitudinally extending core forming a steam passage, said core having a plurality of longitudinally extending openings spaced therearound for discharging steam flowing therein; and e) a supply member for supporting said hair curler while said steam is introduced therein, said support member mounted on said cover and having a first steam discharge port formed therein in flow communication with said cavity, a portion of said support member forming a post disposed in said first steam discharge port, said post extending into said steam passage in said hair curler when said hair curler is supported on said support member, said post forming a longitudinally extending central portion having at least three longitudinally extending spokes extending radially outward therefrom, the number and circumferential spacing of said spokes and the number and circumferential spacing of said openings in said hair curler core being such that no more than one of said spokes can be adjacent said openings when said post extends into said hair curler steam passage.

2. The apparatus according to claim 1, wherein said spokes and said opening in said hair curler core are equidistantly circumferentially spaced, and wherein neither the number of said spokes nor the number of openings is an integer multiple of the other.

3. The apparatus according to claim 1, wherein said openings are circumferentially spaced from each other around said core by a first angle, and wherein said spokes are circumferentially spaced from each other around said post central portion by a second angle, said first and second angles not being equal.

4. The apparatus according to claim 1, wherein said post has exactly three of said spokes.

5. The apparatus according to claim 4, wherein said three spokes are equidistantly circumferentially spaced around said central portion.

6. The apparatus according to claim 5, wherein said hair curler core has only two longitudinally extending openings for discharging said steam formed therein.

7. The apparatus according to claim 6, wherein said two opening in said core are equidistantly circumferentially spaced around said core.

8. The apparatus according to claim 4, wherein said cover has a second steam discharge port formed therein in flow communication with said cavity and said first steam discharge port, and wherein a first one of said spokes is disposed closest to said second steam port, said first spoke extending radially outward from said post central portion in a direction toward said second steam port.

9. The apparatus according to claim 1, wherein said cover has a second steam discharge port formed therein in flow communication with said cavity and said first steam discharge port, and wherein said spokes divide said first steam port in said hair curler support member into a plurality of regions, a first one of said regions being disposed furthest from said second steam port, and further comprising a cowl encircling at least a portion of said first steam port and adapted to direct said steam preferentially into said first region of said first steam port.

10. The apparatus according to claim 1, wherein said support member forms a handle having a finger grip portion for lifting said apparatus.

11. The apparatus according to claim 1, wherein said support member further comprises a baffle portion for deflecting a portion of said steam produced by said water transforming means.

12. The apparatus according to claim 1, wherein said posts are adapted to extend into said steam passage in said hair curler when said steam passage has an inside diameter of 0.2 inch.

13. An apparatus for curling hair, comprising:

a) a vessel forming a cavity for containing water;

b) an electrode for heating said water contained in said cavity thereby transforming at least a portion of said water to steam;

c) a housing supporting said electrode disposed atop said vessel and having a first steam discharge port formed therein in flow communication with said cavity;

d) a cover disposed atop said housing and having a second steam port formed therein in flow communication with said first steam port;

e) a hair curler having a longitudinally extending core forming a steam passage, said core having a plurality of longitudinally extending openings spaced therearound for discharging steam flowing therein; and f) a handle for lifting said steamer attached to said cover, said handle having (i) a support portion adapted to support said hair curler while said steam is introduced therein, (ii) a third steam discharge port formed in said support portion and in flow communication with said second steam discharge port, (iii) a post for stabilizing said hair curler while said steam is introduced therein extending upward from said support portion, whereby said post is adapted to extend into said steam passage in said hair curler, said post forming a longitudinally extending central portion having three longitudinally extending spokes equidistantly circumferentially spaced around said central portion and extending radially outward therefrom, the number and circumferential spacing of said openings in said hair curler core being such that no more than one of said spokes can be adjacent said openings when said post extends into said hair curler steam passage, and (iv) a finger grip portion for lifting said apparatus.

14. In an apparatus for curling hair having (i) a vessel forming a cavity for containing water, (ii) a heater for heating said water contained in said cavity thereby transforming at least a portion of said water to steam, (iii) a cover disposed atop said vessel and having a first steam port formed therein in flow communication with said cavity, (iv) a hair curler having a longitudinally extending core forming a steam passage, said core having a plurality of longitudinally extending openings spaced therearound for discharging steam flowing therein, a handle for lifting said steamer comprising:

a) means for attaching said handle to said cover;

b) a support portion adapted to support one of said hair curlers while said steam is introduced therein;

c) a second steam discharge port formed in said support portion and in flow communication with said first steam discharge port;

d) a post for stabilizing one of said hair curlers while said steam is introduced therein extending upward from said support portion, whereby said post is adapted to extend into said steam passage in said hair curler, said post formed by joining three longitudinally extending members together, each of said members extending radially in a different direction, said member circumferentially spaced around said post such that no more than one of said members can be adjacent said openings in said hair curler core when said post extends into said hair curler steam passage; and e) a finger grip portion for lifting said apparatus.

15. The handle according to claim 14, wherein said post further comprises a central portion, said three members forming three longitudinally extending spokes equidistantly circumferentially spaced around said central portion and extending radially outward therefrom.

16. A system for utilizing steam to curl hair, comprising:

a) a vessel forming a cavity for containing water;

b) means for transforming at least a portion of said water contained in said cavity to steam;

c) a cover disposed atop said vessel and having a first steam discharge port formed therein in flow communication with said cavity;

d) a curler having (i) a core forming as steam passage therein, said core having first and second ends, (ii) first and second rims being disposed on said first and second ends of said core, respectively, and (iii) a porous sleeve enclosing said core and adapted to have hair wound therearound, said core having an inlet opening formed therein for placing said steam passage in flow communication with said sleeve and a plurality of longitudinally extending outlet openings formed therein for discharging steam from said core to said sleeve; and e) a support member for supporting said hair curler while said steam is introduced therein, said support member mounted on said cover and having a second steam discharge port formed therein in flow communication with said first steam discharge port and said curler steam passage, a portion of said support member forming a post disposed in said second steam discharge port and extending into said curler steam passage, said post forming a longitudinally extending central portion having at least three longitudinally extending spokes extending radially outward therefrom, the number and circumferential spacing of said spokes and the number and circumferential spacing of said outlet openings in said hair curler core being such that no more than one of said spokes can be adjacent said outlet openings when said post extends into said hair curler steam passage.

17. The system according to claim 16, further comprising a shield adapted to at least partially enclose said sleeve after said hair has been wound therearound.

* * * * *